US005375352A

United States Patent [19]

Morris

[11] Patent Number: 5,375,352

[45] Date of Patent: Dec. 27, 1994

[54] DISPLAY PANEL ASSEMBLY FOR COLLECTIBLE ITEMS

[76] Inventor: James M. Morris, 55 Brentwood Dr., Avon, Conn. 06001

[21] Appl. No.: 67,822

[22] Filed: May 27, 1993

[51] Int. Cl.[5] ..... B44C 5/02

[52] U.S. Cl. ..... 40/158.1; 40/159

[58] Field of Search ..... 40/158.1, 159, 152, 40/661

[56] References Cited

U.S. PATENT DOCUMENTS

| | | | |
|---|---|---|---|
| B 456,153 | 3/1976 | Anderson | 40/159 |
| 1,139,075 | 5/1915 | Roy | 40/158.1 |
| 1,960,813 | 5/1934 | Holder | 40/124.2 |
| 1,980,241 | 11/1934 | Wilson et al. | 40/159 |
| 2,282,872 | 5/1942 | Mayer et al. | 40/159 |
| 2,886,907 | 5/1959 | Stephenson | 40/124.2 |
| 3,079,771 | 3/1963 | Donle | 40/152 |
| 3,642,552 | 2/1972 | Sibley | 40/159 |
| 3,797,146 | 3/1974 | Holes | 40/159 |
| 3,816,948 | 6/1974 | Mooney et al. | 40/159 |
| 4,250,640 | 2/1981 | Culhane | 40/159 |
| 4,860,468 | 8/1989 | Cliborn | 40/124.2 |
| 4,988,556 | 1/1991 | Nilsen et al. | 40/158.1 |
| 5,000,319 | 3/1991 | Mermelstein | 40/159 |
| 5,040,671 | 8/1991 | Hager | 206/45.34 |
| 5,044,100 | 9/1991 | Roberts | 40/159 |
| 5,119,574 | 6/1992 | King | 40/159 |

FOREIGN PATENT DOCUMENTS

| | | | |
|---|---|---|---|
| 0214016 | 3/1987 | European Pat. Off. | 40/158.1 |

*Primary Examiner*—Edward K. Look
*Assistant Examiner*—Mark Sgantzos
*Attorney, Agent, or Firm*—Paul E. Milliken; Lee A. Germain

[57] ABSTRACT

A windowed display panel assembly for retaining multiple flat collectible items such as sports cards, photographs and other flat items in such manner that the items can be viewed from both sides without removing the items from the panel. The assembly has a rigid transparent front panel, a flexible transparent pocketed rear sheet which is retained in surface contact with the front panel by a peripheral frame to form a rigid assembly which provides both front and back viewing of cards displayed in the assembly and permits the cards to be easily removed and replaced in the assembly.

20 Claims, 4 Drawing Sheets

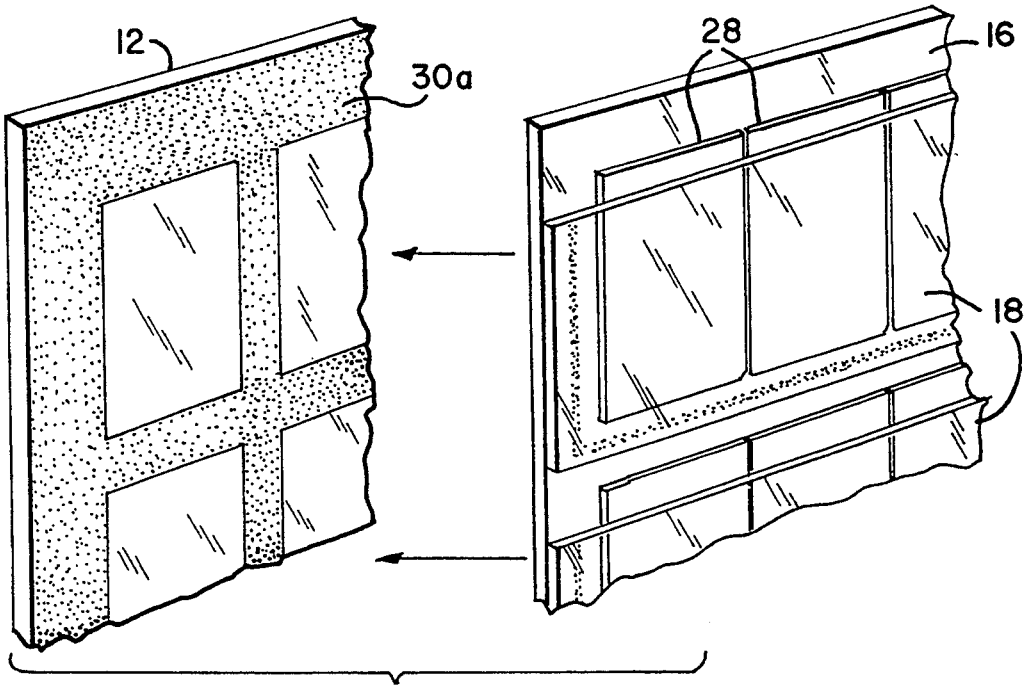
FIG. 5
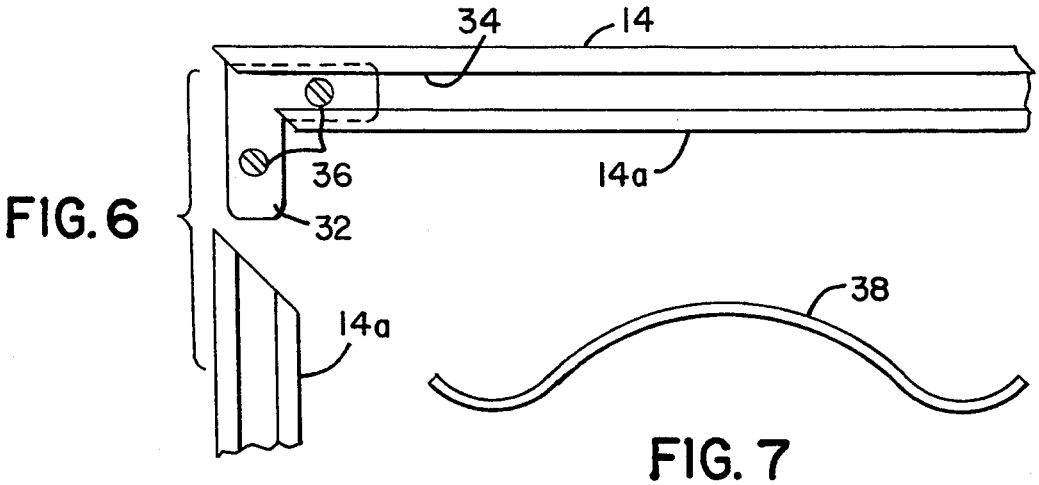
FIG. 6
FIG. 7
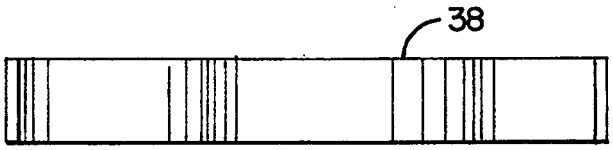
FIG. 8
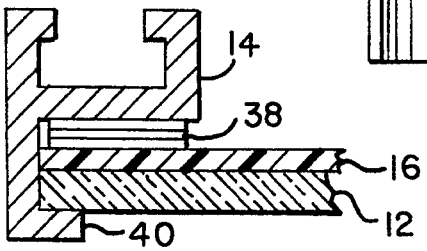
FIG. 9

DISPLAY PANEL ASSEMBLY FOR COLLECTIBLE ITEMS

FIELD OF THE INVENTION

This invention relates generally to windowed display panel assemblies for retaining multiple flat collectible items and more specifically to collectors' cards such as sports cards, photographs and other flat items in such manner that the items can be viewed from both sides without removing the items from the panel.

BACKGROUND OF THE INVENTION

In the past various types of transparent display panels have been devised from viewing sports cards, photographs, stamps and other flat collectible items.

One such display panel is shown in U.S. Pat. No. 4,860,468 issued to D L Cliborn which shows a particular way of forming card retaining pockets in a multilayered panel.

A transparent or translucent flexible page for storing photographic negatives is shown in U.S. Pat. No. 5,000,319 issued to L Mermelstein.

A display device for stamps or coins is shown in U.S. Pat. No. 2,282,872 in which cut-out portions are provided in one of the layers of the device for receiving the items to be displayed.

Each of the prior art patents approaches the problem of providing spaces or pockets for the displayed items and transparent cover sheets in a particular manner.

OBJECTS OF THE INVENTION

An object of the present invention is to provide a display panel for flat collectible items such as sports cards and the like which may be seen from both the front and the back without removing the items from the panel.

Another object of the invention is to provide a display panel which is simple attractive and easy to access the items stored in the panel.

A still further object of the invention is to provide a display panel for flat collectible items which makes it easy to see the items displayed while providing anti-theft storage of the items.

These and other objects of the invention will become more fully apparent in the following specification and the attached drawings.

SUMMARY OF THE INVENTION

This invention is a display panel assembly for protectively retaining flat collectible items comprising a rigid front panel of transparent material having a front face and a back comprising a flexible back sheet of transparent material having a front face and a back face and being positioned coextensively with the front panel, a plurality of strips of flexible transparent material attached to the back side of the back sheet with each strip being attached along its bottom edge and end edges to form elongated horizontal pockets on the back side of the back sheet for receiving and supporting a plurality of flat collectible items therein, a windowed mat means positioned between the front panel and the back sheet and coextensive therewith, said mat means having an opaque grid defining a plurality of open windows positioned to be in alignment with flat collectible items which may be positioned in the pockets, so that the fronts of the collectible items are visible through the open windows of the mat means and the rear of the collectible items are visible through the transparent strips forming the pockets, and retaining means extending along at least part of the marginal edges of the front panel and the rear sheet to hold them in fixed coextensive relationship with each other.

DESCRIPTION OF THE DRAWINGS

FIG. 5 is a fragmentary exploded perspective view of another embodiment of the invention with an opaque mat printed on a transparent front panel;

FIG. 6 is a fragmentary exploded view of a typical corner of a frame for the display panel of the invention;

FIG. 7 is an enlarged side elevational view of a retaining spring for use with the frame shown in FIG. 6;

FIG. 8 is an enlarged plan view of the spring shown in FIG. 7;

FIG. 9 is a cross sectional through a typical frame around a panel assembly showing how the spring of FIGS. 7 and 8 holds the panels in position in the frame;

DESCRIPTION OF THE PREFERRED EMBODIMENTS

Figure 1:
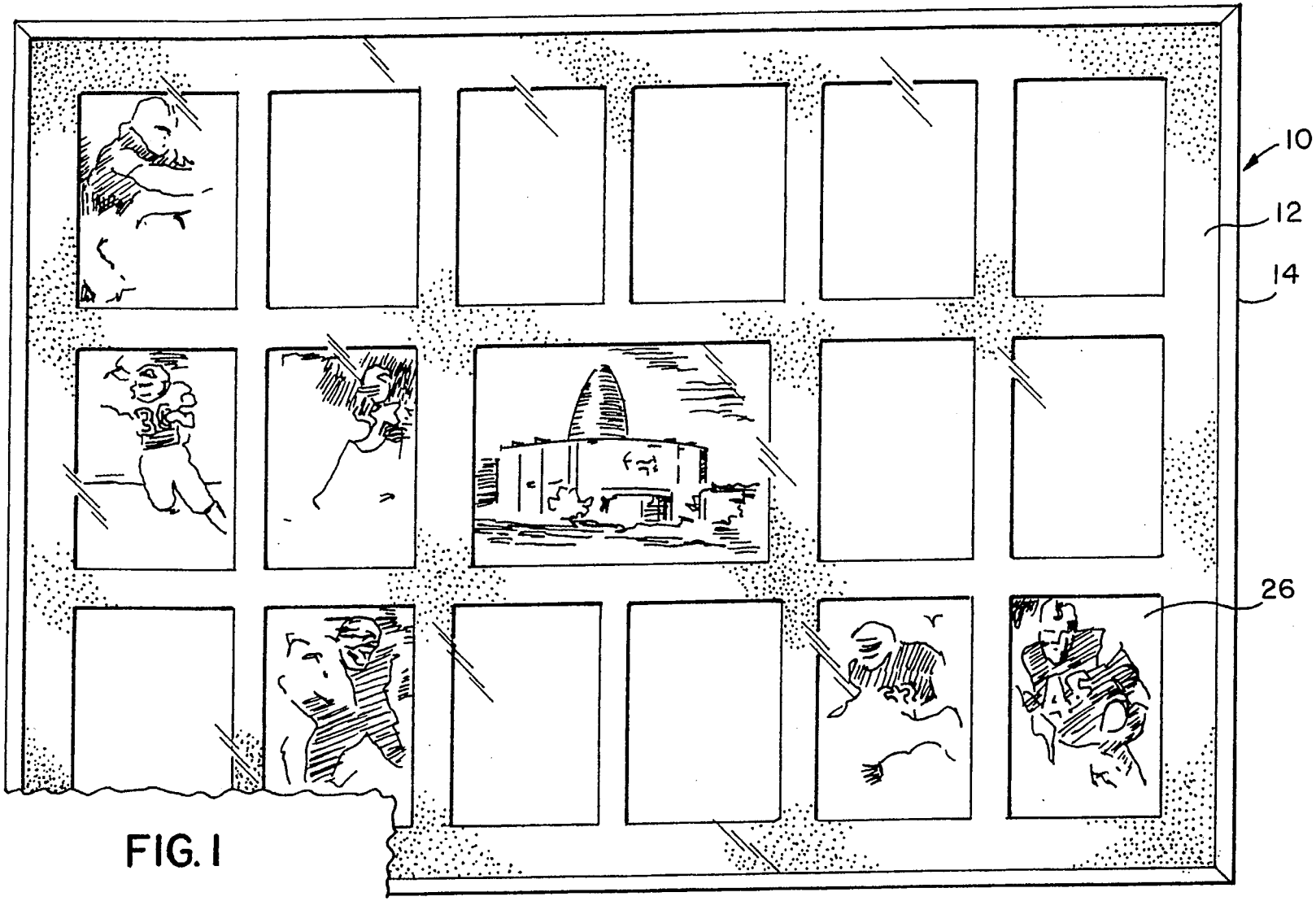
FIG. 1 is a front elevational view of a typical display panel of the invention.
Figure 3:
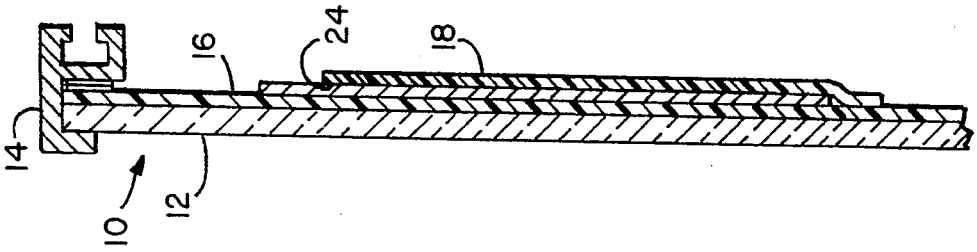
FIG. 3 is a cross-sectional view taken on line 3—3 of FIG. 2.
Figure 2:
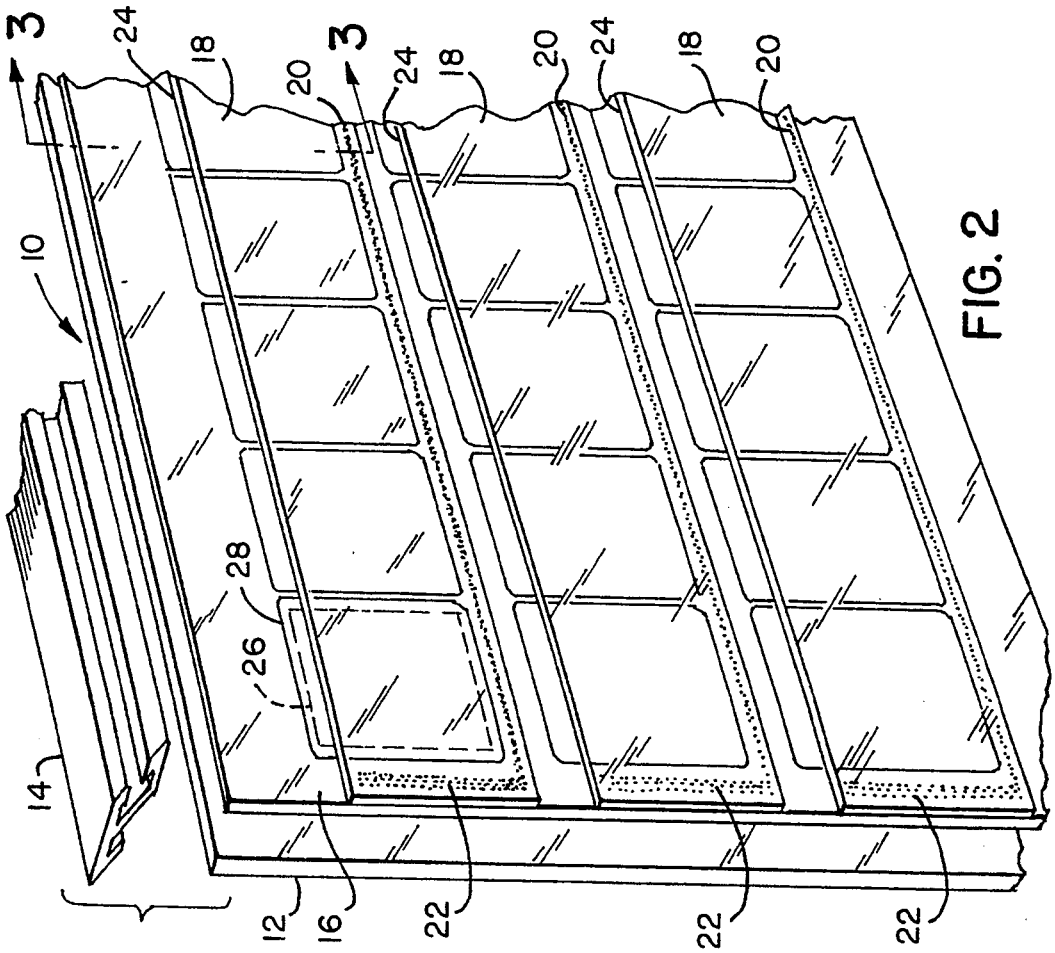
FIG. 2 is a fragmentary exploded perspective view of one embodiment of the invention.

Referring to the drawings, FIGS. 1–3 show a panel assembly 10 having a transparent rigid front panel 12 of glass, Plexiglas or other suitable material surrounded by a frame 14. Behind the front panel 12 is a flexible transparent plastic back sheet or panel 16 which is positioned coextensively with the front panel 12 with the panel 12 and the sheet or panel 16 having marginal edges adjacent to each other. Attached to the back sheet 16 are a plurality of horizontal strips 18 of the same or similar thermoplastic material to that of the back sheet 16. The strips 18 are heat sealed or adhesively attached to the sheet 16 at the bottom and ends as shown by the seams 20 and 22 to form elongated horizontal pockets 24 for receiving flat collectible items such as sports cards 26 in clear transparent plastic covers 28.

Figure 10:
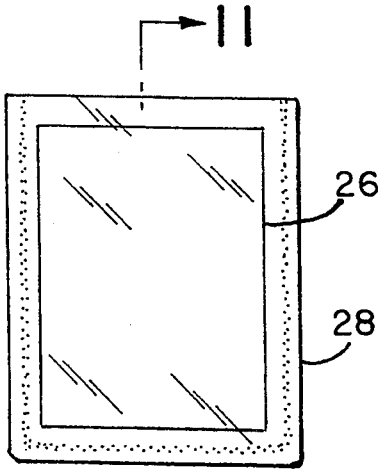
FIG. 10 is a front elevational view of a collectable card in a transparent plastic cover.
Figure 11:
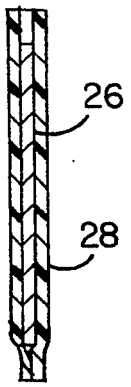
FIG. 11 is a cross-sectional view taken on line 11—11 of FIG. 10.

A detail of the cards 26 in the covers 28 is shown in FIGS. 10 and 11.

Figure 4:
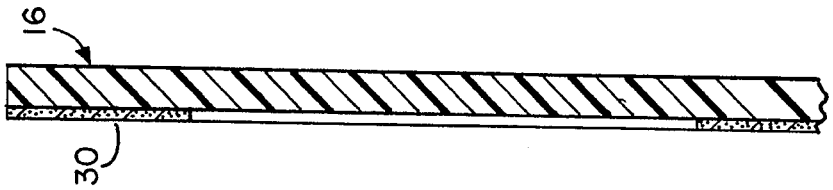
FIG. 4 is an enlarged fragmentary cross-sectional view of the back panel shown in FIG. 3 with an opaque windowed mat printed thereon.

As shown in FIG. 4, the back sheet 16 has an opaque windowed mat 30 printed on its front face in such a location that when the cards 26 in plastic covers are placed in the elongated pockets 24, the windows in the mat are in alignment with the cards 26 and permit viewing of the front face of the cards. Since the strips 18 forming the back of the pockets 24 are transparent the back side of the cards 26 can be viewed from the back side of the panel assembly 10.

Another embodiment of the invention is shown in FIG. 5 which the mat 30*a* is printed on back face of the front panel 12 instead of on the front face of the back sheet 16 as previously shown in FIGS. 2 through 4. It will be understood that the mat 30 or 30*a* can be printed on the back sheet 16 or the front panel 12 respectively by silk screening or any other suitable process.

Figure 12:
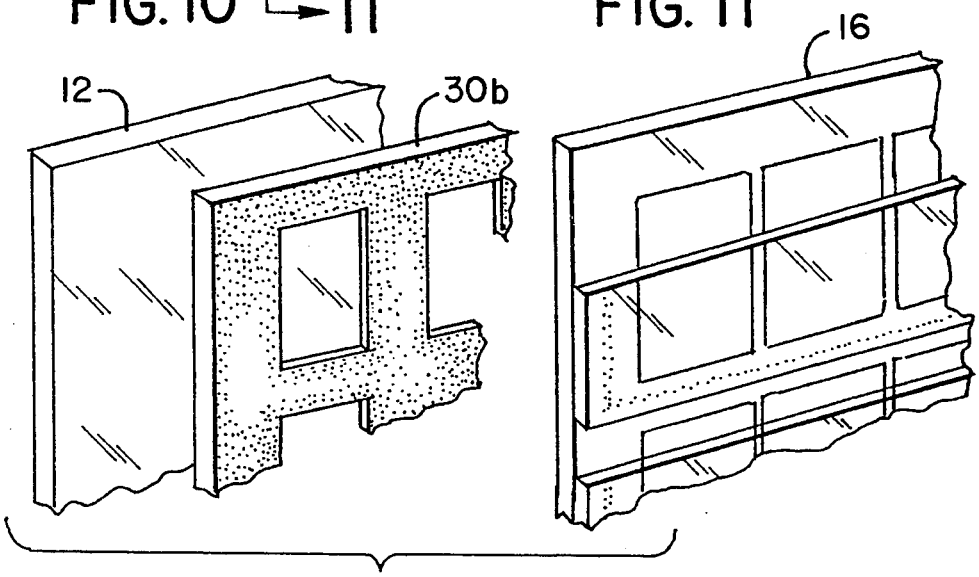
FIG. 12 is a fragmentary exploded perspective view of another embodiment of the invention.

It will also be recognized that another alternative to the mat 30 or 30*a* is the mat 30*b* shown in FIG. 12 where the mat 30*b* is made as a separate windowed layer positioned between the front panel 12 and the back sheet 16.

FIG. 6 shows a typical corner of the frame 14 in which an L-shaped corner bracket 32 is positioned in a back undercut groove 34 in the frame segments 14*a* and screws 36 are tightened to retain the bracket 32 and segments 14*a* in fixed relationship to each other.

FIG. 9 shows a cross-sectional view through the frame 14 wherein a spring 38 such as that shown in detail in FIGS. 7 and 8 is positioned between a portion of the frame 14 and the back sheet 16 to hold the sheet 16 and the front panel 12 against a rib 40 and hold the marginal edges of the panel 12 and sheet 16 firmly in the frame 14.

Figure 13:
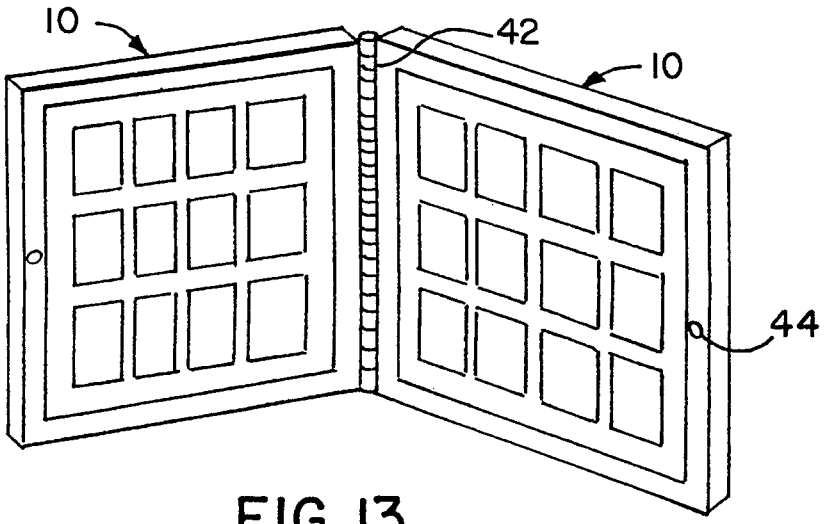
FIG. 13 is a perspective view showing a variation of the invention with a pair of display panel assemblies in hinged back to back relationship with each other.

It should be understood the various combinations of the panel assembly 10 can be made such as the variation shown in FIG. 13 where a pair of the panel assemblies are hinged back to back by a hinge 42 and can be locked together by a lock 44 to prevent access to the displayed items to avoid theft of the items. The lock 44 can be unlocked to reveal the back side of the displayed cards 26.

In addition to the frame 14 shown in the drawings, various other types of frames can be used to hold together the rigid front panel 12 and the flexible back sheet 16 and form a rigid display panel assembly such as the assembly 10 which can be viewed from both the front and the back side. It should also be understood that this assembly 10 can be displayed in a vertical, horizontal angular position without departing from the scope of the invention. These and other variations can be made in the assembly without departing from the scope of the invention.

I claim:

1. A display panel assembly for protectively retaining flat collectible items comprising:

(A) a rigid front panel of transparent material having a front face, a back face and marginal edges extending around the faces;

(B) a flexible back sheet of transparent material having a front face, a back face and marginal edges extending around the faces and being positioned coextensively with the front panel;

(C) a plurality of strips of flexible transparent material having a bottom edge and end edges attached to the back face of the back sheet with each strip being attached along its bottom edge and end edges to form elongated horizontal pockets on the back face of the back sheet for receiving and supporting a plurality of flat collectible items therein;

(D) a windowed mat means positioned between the front panel and the back sheet and coextensive therewith, said mat means having an opaque grid defining a plurality of open windows positioned to be in alignment with flat collectible items which may be positioned in the pockets, so that the fronts of the collectible items are visible through the open windows of the mat means and the rear of the collectible items are visible through the transparent strips forming the pockets; and (E) retaining means extending along at least part of the marginal edges of the front panel and the back sheet to hold them in fixed coextensive relationship with each other.

2. A panel assembly as claimed in claim 1 wherein the mat means is printed on the front face of the back sheet.

3. A panel assembly as claimed in claim 1 wherein the mat means is printed on the back face of the front panel.

4. A panel assembly as claimed in claim 1 wherein the front panel and the back sheet are both made from transparent plastic materials.

5. A panel assembly as claimed in claim 1 wherein the transparent strips are made of the same material as the back sheet.

6. A panel assembly as claimed in claim 5 wherein the transparent strips and the back sheet are made of thermoplastic material.

7. A panel assembly as claimed in claim 6 wherein the strips are attached to the back sheet by heat sealed seams.

8. A panel assembly as claimed in claim 1 wherein the strips are adhesively bonded to the back sheet.

9. A panel assembly as claimed in claim 1 wherein the retaining means is a frame extending around all the marginal edges of the front panel and the back sheet.

10. A panel assembly as claimed in claim 1 wherein a pair of panel assemblies are hingedly mounted back to back along a pair of adjacent vertical edges of each panel assembly so that the assemblies can be swung apart in order to view the back side of the items displayed in both assemblies.

11. A display panel assembly for protectively retaining flat collectible cards comprising:

(A) a rigid front panel of transparent material having a front face, a back face and marginal edges extending around the faces;

(B) a flexible back panel of transparent material having a front face, a back face and marginal edges extending around the faces and being positioned coextensively with the front panel;

(C) a plurality of strips of flexible transparent material having a bottom edge and end edges attached to the back face of the back panel with each strip being attached along its bottom edge and end edges to form elongated horizontal pockets on the back face of the back panel for receiving and supporting a plurality of flat collectible cards therein;

(D) a windowed mat means printed on a face of one of the panels which is adjacent to a face of the other panel, said mat means having an opaque grid defining a plurality of open windows positioned to be in alignment with flat collectible cards which may be positioned in the pockets, so that the fronts of the collectible cards are visible through the open windows of the mat means and the rear of the collectible items are visible through the transparent strips forming the pockets; and (E) retaining means extending along at least part of the marginal edges of the front panel and the rear panel to hold them in fixed coextensive relationship with each other.

12. A panel assembly as claimed in claim 11 wherein the mat means is printed on the front face of the back panel.

13. A panel assembly as claimed in claim 11 wherein the mat means is printed on the back face of the front panel.

14. A panel assembly as claimed in claim 11 wherein the front panel and the back panel are both made from transparent plastic materials.

15. A panel assembly as claimed in claim 11 wherein the transparent strips are made of the same material as the back panel.

16. A panel assembly as claimed in claim 15 wherein the transparent strips and the back panel are made of thermoplastic material.

17. A panel assembly as claimed in claim 16 wherein the strips are attached to the back panel by heat sealed seams.

18. A panel assembly as claimed in claim 11 wherein the strips are adhesively bonded to the back panel.

19. A panel assembly as claimed in claim 11 wherein the retaining means is a frame extending around all the marginal edges of the front panel and the back panel.

20. A display panel assembly for protectively retaining flat collectible items comprising:

(A) a rigid front panel of transparent material having a front face, a back face and marginal edges extending around the faces;

(B) a flexible back panel of transparent plastic material having a front face, a back face and marginal edges extending around the faces and being positioned coextensively with the front panel;

(C) a plurality of strips of flexible transparent plastic material having a bottom edge and end edges attached to the back face of the back panel with each strip being attached along its bottom edge and end edges to form elongated horizontal pockets on the back face of the back panel for receiving and supporting a plurality of flat collectible items therein;

(D) a windowed mat means printed on the front face of the back panel, said mat means having an opaque grid defining a plurality of open windows positioned to be in alignment with flat collectible items which may be positioned in the pockets, so that the fronts of the collectible items are visible through the back panel in the area of the open windows of the mat means and the rear of the collectible items are visible through the transparent strips forming the pockets; and (E) retaining means engaging the marginal edges of both panels to hold them in fixed coextensive relationship with each other.

* * * * *